US011395388B1

(12) United States Patent
Han et al.

(10) Patent No.: US 11,395,388 B1
(45) Date of Patent: Jul. 19, 2022

(54) CURRENT DRIVER

(71) Applicant: Dialog Semiconductor (UK) Limited, London (GB)

(72) Inventors: Ze Han, Beijing (CN); Nailong Wang, Beijing (CN); Zhenyu Song, Beijing (CN)

(73) Assignee: Dialog Semiconductor (UK) Limited, London (GB)

( * ) Notice: Subject to any disclaimer, the term of this patent is extended or adjusted under 35 U.S.C. 154(b) by 0 days.

(21) Appl. No.: 17/367,712

(22) Filed: Jul. 6, 2021

Related U.S. Application Data

(63) Continuation of application No. PCT/CN2021/091385, filed on Apr. 30, 2021.

(51) Int. Cl.
*H05B 45/30* (2020.01)
*G09G 3/32* (2016.01)

(52) U.S. Cl.
CPC ..... *H05B 45/30* (2020.01)

(58) Field of Classification Search
CPC ..... H05B 45/00; H05B 45/10; H05B 45/30; H05B 45/325; H05B 45/03; H05B 45/37; G09G 3/32; G09G 3/3233; G09G 3/325; G09G 2300/00; G09G 2300/0866
See application file for complete search history.

(56) References Cited

U.S. PATENT DOCUMENTS

2009/0040212 A1 2/2009 Wang
2013/0057239 A1* 3/2013 Kalje ..... H02M 3/1584 323/271
2014/0002332 A1 1/2014 Huang et al.
2014/0375679 A1 12/2014 Margolis et al.
2020/0127564 A1* 4/2020 Zhao ..... H03F 3/345
2021/0056891 A1 2/2021 Wei et al.
2021/0056892 A1 2/2021 Wei et al.
(Continued)

FOREIGN PATENT DOCUMENTS

CN 104715714 A 6/2015
CN 110136643 A 8/2019
CN 112489587 A 3/2021

OTHER PUBLICATIONS

Datasheet: "Single-Wire, I/O Powered 1-Kbit (128 s 8) Serial EEPROM with a Unique, Factory-Programmed 64-Bit Serial Number," Copyright 2020 Microchip Technology Inc., 47 pages.
(Continued)

*Primary Examiner* — Thai Pham
(74) *Attorney, Agent, or Firm* — Saile Ackerman LLC; Stephen B. Ackerman

(57) ABSTRACT

There is presented a current driver and a corresponding method for driving a current-controlled component such as a semiconductor light source with a driving current. The current driver includes a current regulator for regulating the driving current, a power circuit, and an input stage. The input stage receives a first signal and a second signal and is operable in two phases. In the first phase, the first signal is used to power the power circuit, and in the second phase, the second signal is used to power the power circuit. The current driver may be implemented in an array of cells in which each cell includes a current driver coupled to a current controlled component. The array of cells may be a part of a display device.

18 Claims, 11 Drawing Sheets

(56) References Cited

U.S. PATENT DOCUMENTS

| | | | |
|---|---|---|---|
| 2021/0056893 | A1 | 2/2021 | Wei et al. |
| 2021/0312859 | A1 | 10/2021 | Yang et al. |

OTHER PUBLICATIONS

PCT Search Report, International Application No. PCT/CN2021/091385, Applicant: Dialog Semiconductor (UK) Limited, dated Jan. 25, 2022, 10 pages.

* cited by examiner

CURRENT DRIVER

This application is a Continuation of Application No. PCT/CN2021/091385 which was filed on Apr. 30, 2021, assigned to a common assignee, and which is herein incorporated by reference in its entirety.

TECHNICAL FIELD

The present disclosure relates to a current driver for use in an array of current controlled components. In particular, the present disclosure relates to a current driver for use in an array of semiconductor light sources.

BACKGROUND

High definition Thin Film Transistor (TFT) displays, and televisions require localized dimming control for each pixel or for a small number of pixels. As a result, each localized dimming zone requires an LED or LED string to be individually controlled and dimmed by a dedicated LED driver. The LED(s) and associated LED driver integrated circuits (ICs) are distributed across the TFT matrix. Consequently, the integration of many LED drivers in a single device is not practical due to routing complexity. Instead, single channel LED drivers are typically used or less often 2/4 channel drivers.

Conventional single channel LED drivers require four ports: a power port for receiving a power input voltage, a control port for receiving an LED control signal via a TFT, a drive port to drive the LED or string of LEDs, and a ground port. The trend towards increased pixel densities, and the requirements for individual dimming renders signal routing extremely difficult. In practice the number of layers of the substrate increases hence increasing design complexity and cost of production.

SUMMARY

It is an object of the disclosure to address one or more of the above-mentioned limitations.

According to a first aspect of the disclosure, there is provided a current driver for driving a current-controlled component with a driving current, the current driver comprising a current regulator for regulating the driving current; a power circuit; and an input stage adapted to receive a first signal and a second signal, the input stage being operable in a first phase during which the first signal is used to power the power circuit, and a second phase during which the second signal is used to power the power circuit.

For instance, the current-controlled component may be a semiconductor light source such as an LED or a string of LEDs.

Optionally, the input stage is adapted to provide a control signal to control the current regulator.

Optionally, the input stage has a first port for receiving the first signal and a second port for receiving the second signal.

Optionally, the input stage has a single input port for receiving both the first signal and the second signal.

Optionally, the input stage comprises a first diode coupling the first port to a capacitor, a second diode coupling the second port to the capacitor, and a switch having a control terminal coupled to the second port.

For instance, the capacitor may be a reservoir capacitor coupled to the power circuit.

Optionally, the input stage comprises a diode coupling the single input port to a capacitor, a comparator coupled to the single input port, and a switch having a control terminal coupled to the output of the comparator.

Optionally, the current driver may be semiconductor light source driver.

According to a second aspect of the disclosure there is provided a device comprising an array of cells, each cell comprising a current driver according to the first aspect coupled to a current-controlled component.

Optionally, the array comprises a pluralities of columns and rows, the device further comprising a plurality of row drivers, each row driver being adapted to provide a row signal to a corresponding row, and a plurality of column drivers, each column driver being adapted to provide a column signal to a corresponding column.

Optionally, each current driver comprises a first port for receiving the row signal and a second port for receiving the column signal.

Optionally, when the row signal is high the current driver is powered by the row driver and when the row signal is low the current driver is powered by the column driver.

Optionally, the device further comprises a power supply, wherein the current driver is coupled to the column driver via a first switch and to the power supply via a second switch.

Optionally, the row signal has a first state and a second state, the row signal being adapted to control the first switch and the second switch such that when the row signal is in the first state the current driver is powered by the power supply and when the row signal is in the second state the current driver is powered by the column signal.

For example, the first state is a low state for instance logic 0 and the second state is a high state for instance a logic 1.

Optionally, the first switch comprises a single transistor and the second switch comprises a single transistor.

For instance, the first switch may be an N-Type transistor and the second switch may be a P-type transistor.

Optionally, the first switch comprises a first pair of transistors and the second switch comprises a second pair of transistors.

For instance, the first pair may be a pair of N-type transistors and the second pair may be a pair of P-type transistors.

Optionally, the first pair comprises a first transistor and a second transistor, wherein the first transistor has a drain terminal connected to the drain terminal of the second transistor; and wherein the second pair comprises a third transistor and a fourth transistor, wherein the third transistor has a source terminal connected to the source terminal of the fourth transistor.

Optionally, the device is a display device comprising a plurality of semiconductor light sources, each semiconductor light source among the plurality of light sources being coupled to a corresponding current driver.

For instance, the semiconductor light sources may be LEDs or strings of LEDs.

According to a third aspect of the disclosure, there is provided a method of driving a current-controlled component with a driving current, the method comprising

- providing a current regulator for regulating the driving current;
- providing a power circuit;
- generating a first signal and a second signal;
- providing an input stage adapted to receive the first signal and the second signal,
- operating the input stage in a first phase during which the first signal is used to power the power circuit, and operating the input stage in a second phase during which the second signal is used to power the power circuit.

The options described with respect to the first aspect of the disclosure are also common to the second and third aspects of the disclosure.

BRIEF DESCRIPTION OF THE DRAWINGS

The disclosure is described in further detail below by way of example and with reference to the accompanying drawings, in which.

DESCRIPTION

Figure 1A:
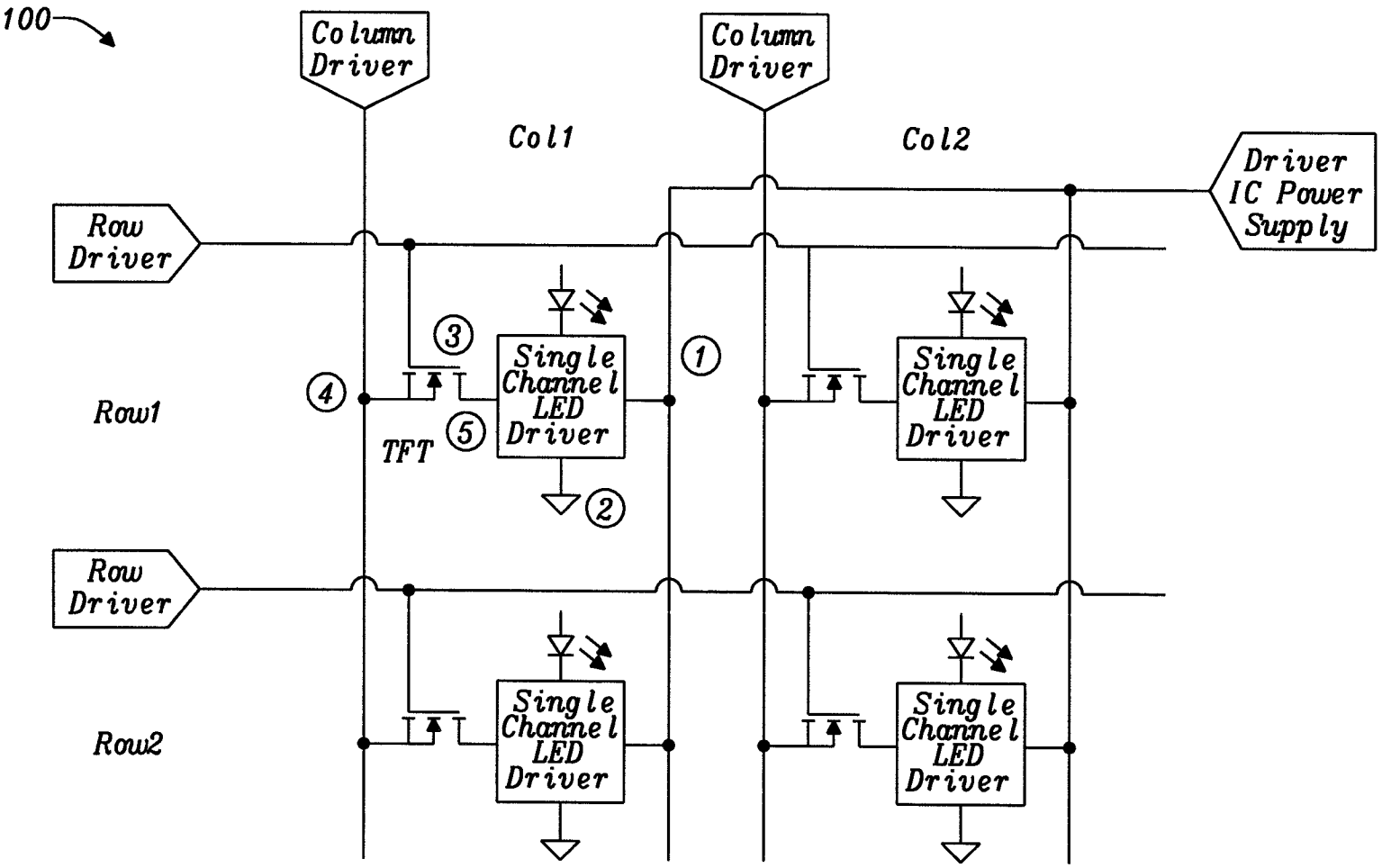
FIG. 1A Prior Art
FIG. 1A is a diagram of an array of LEDs that can be found in a conventional display device.

FIG. 1A illustrates the architecture of an array of LEDs that can be found in a conventional display device.

The display is formed of an array of cells. Each cell has a single channel LED driver connected to a corresponding LED, and a Thin Film Transistor (TFT). The array has a pluralities of columns Col1, Col2 and rows Row1, Row2. In this example four cells are represented: (Col1, Row1), (Col2, Row1), (Col1, Row2), (Col2, Row2). A row driver is provided for each row and a column driver is provided for each column. In addition a power supply is provided to power each single channel LED driver.

The cells are identical and wired as follows. The TFT has a source terminal connected to the column driver, a gate transistor connected to the row driver and a drain terminal connected to the single LED driver.

Figure 1B:
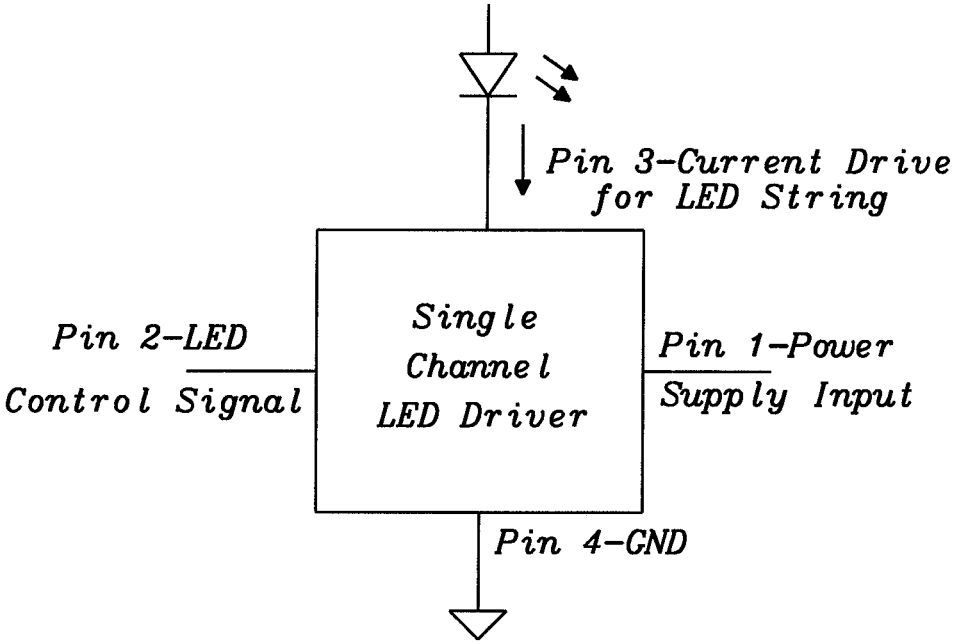
FIG. 1B Prior Art
FIG. 1B is a diagram of conventional single channel LED driver.

FIG. 1B shows a single channel LED driver as used in FIG. 1A. The single channel LED driver has four ports or terminals: a power port (Pin 1) for receiving an input from the power supply, a control signal port (Pin 2) for receiving an LED control signal via the TFT, an LED current drive port (Pin 3) connected to the LED or string of LEDs, and a ground port (Pin 4) connected to ground.

Figure 2:
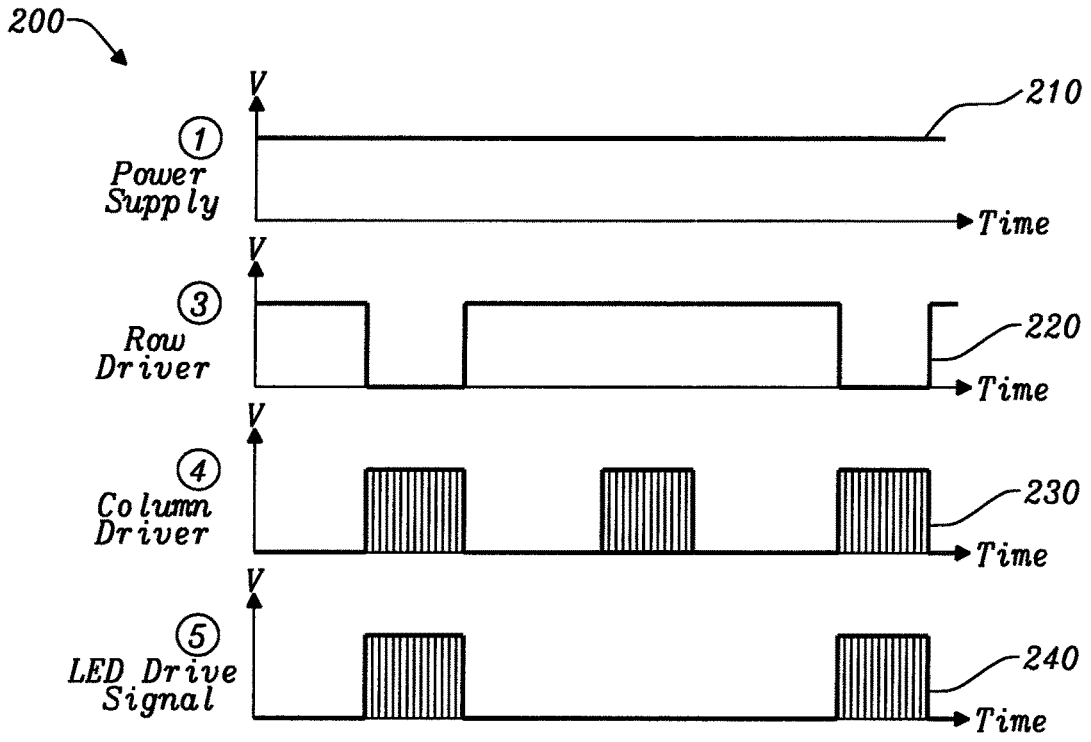
FIG. 2 is a waveform diagram illustrating the working of the circuit of FIG. 1A.

FIG. 2 is a waveform diagram illustrating the working of the circuit of FIG. 1A. The diagram 200 shows the constant voltage 210 provided by the power supply, the row voltage signal 220 provided by the row driver, the column voltage signal 230 provided by the column driver and the LED drive signal 240 (also referred to as control signal) provided at the drain of the TFT.

In operation, each LED or LED string can be individually dimmed and is controlled by a dedicated LED driver. The combination of the row voltage signal 220 provided at the gate of the TFT with the column voltage signal 230 provided at the source of the TFT, results in the LED drive signal 240 provided at the TFT drain. When the signal 220 is low, the signal 230 is passed to the drain. When the signal 220 is high the signal 230 is blocked. When the LED control signal 240 is high, the LED current drive terminal (Pin 3) allows a regulated current to flow through the LED or LED string.

Figure 3:
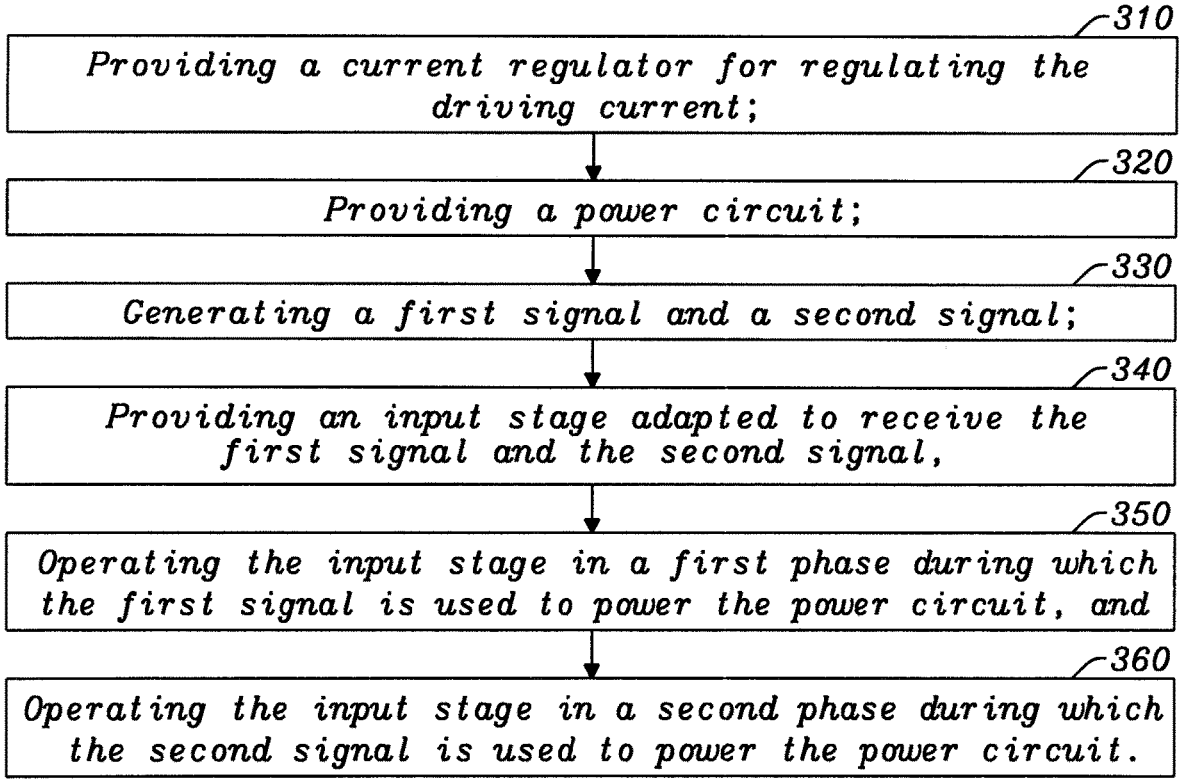
FIG. 3 is a flow chart of a method for driving a current-controlled component with a driving current according to the disclosure.

FIG. 3 is a flow chart of a method for driving a current-controlled component with a driving current. At step 310 a current regulator is provided for regulating the driving current. At step 320 a power circuit is provided to power the current regulator. At step 330 a first signal and a second signal are generated. At step 340 an input stage adapted to receive the first signal and the second signal is provided. At step 350 the input stage is operated in a first phase during which the first signal is used to power the power circuit, and at step 360 the input stage is operated in a second phase during which the second signal is used to power the power circuit.

Figure 4A:
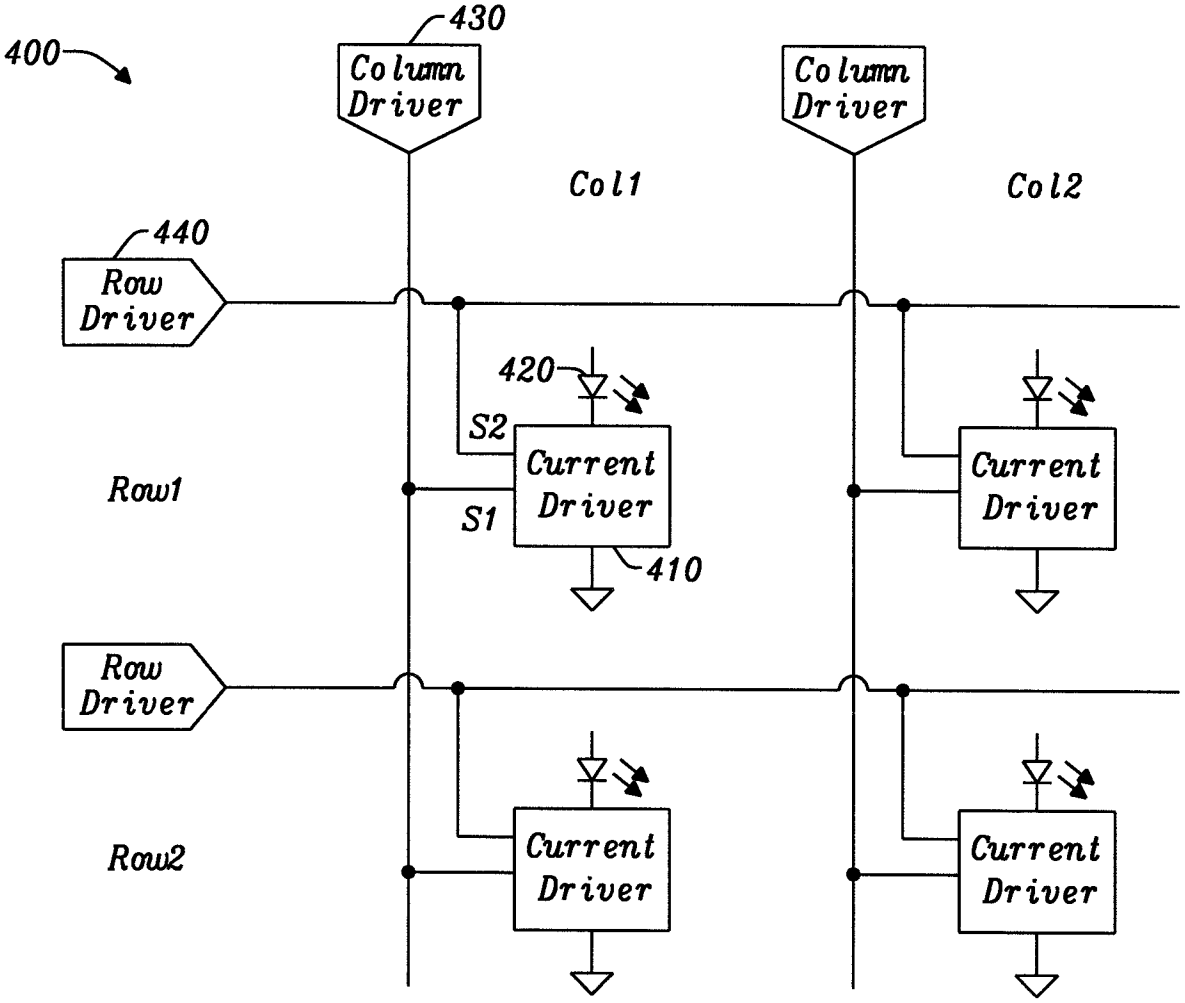
FIG. 4A is a diagram of an array cells according to the disclosure.

FIG. 4A is a diagram of a circuit such as a display circuit according to the disclosure. The circuit 400 includes an array of cells, each cell having a current driver 410 coupled to a current-controlled component 420. In this example the current-controlled component is a semiconductor light sources such as an LED or a string of LEDs. The array has a pluralities of columns Col1, Col2 and rows Row1, Row2. In this example four cells are represented: (Col1, Row1), (Col2, Row1), (Col1, Row2), (Col2, Row2), however it will be appreciated that many more cells could be implemented in the same fashion.

A row driver 440 is provided for each row and a column driver 430 is provided for each column. Each row driver is adapted to provide a row signal S2 to a corresponding row. The row signal S2 may be a synchronisation signal such as a clock signal. Similarly each column driver is adapted to provide a column signal S1 to a corresponding column. The column signal S1 may include a low frequency component and a high frequency component that carries information or data. Data may be encoded using phase encoding, for example using the Manchester code. The cells are identical and wired as described with reference to the first cell (Col1, Row1).

Figure 4B:
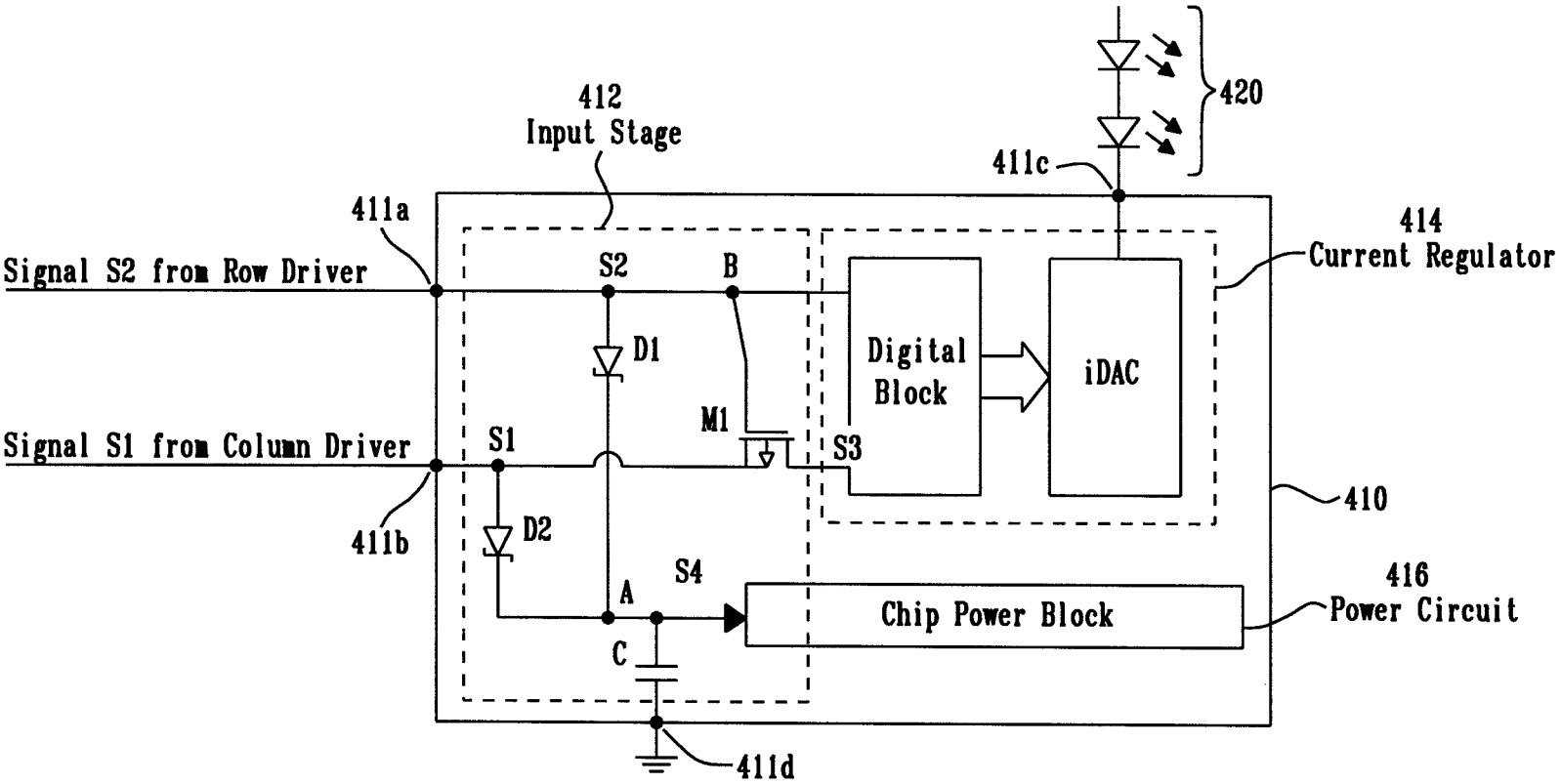
FIG. 4B is a current driver for use in the circuit of FIG. 4A.

FIG. 4B shows a current driver 410 for driving a current-controlled component with a driving current. The current driver 410 includes a current regulator 414 for regulating the driving current; a power circuit 416 for powering the current regulator, and an input stage 412. The input stage 412 is adapted to receive a first signal S1 from the column driver and a second signal S2 from the row driver. The input stage 412 is operable in two phases. In the first phase the first signal S1 is used to power the power circuit 416, and in the second phase the second signal S2 is used to power the power circuit 416.

In the present example the current driver 410 is an LED driver for use in the display circuit of FIG. 4A. In more details, the current driver 410 has four ports or terminals referred to as first port, second port, third port and fourth port. The first port 411*a* is adapted to receive the row signal S1 from the row driver. The second port 411*b* is adapted to receive the column signal S2 from the column driver. The third port 411*c*, also referred to current drive port is coupled to the current-controlled component 420. The ground port 411*d* is coupled to ground.

The input stage 412 has two inputs for receiving the signals S1 and S2 and two outputs for providing a power signal S4 to the power circuit 416 and a control signal S3 to the current regulator 414. The input stage 412 could be implemented in various fashions. In this example the input stage 412 has two diodes D1 and D2 (for instance two Schottky diodes), a switch M1 and a capacitor C. The switch M1 may be a P-type transistor. The capacitor C has a first terminal coupled the power circuit 416 at node A and a second terminal coupled to ground. The first diode D1 has a first terminal coupled to the first port 411*a* and a second terminal coupled to the capacitor C at node A. The second diode D2 has a first terminal coupled to the second port 411*b* and a second terminal coupled to the capacitor C at node A. The switch M1 has a control terminal, for instance a gate terminal coupled to port 411*a* at node B, a second terminal for instance a source terminal coupled to port 411*b*, and a third terminal for instance a drain terminal coupled to the current regulator 414.

The current regulator 414 has a first input coupled to the first port 411*a* at node B, a second input coupled to the second port 411*b* via M1, and an output coupled to the third port 411*c*. The current regulator 414 can be implemented in various ways. In this example the current regulator includes a digital circuit coupled to a current digital-to-analog convertor iDAC. The digital circuit receives the control signal S3 which provides data to operate the iDAC, for instance to vary the intensity of the current flowing through the LED, hence the intensity of emitted light. The digital circuit also received the signal S2 as a clock signal. The signal S3 can be a digital data signal. For instance S3 may carry data using phase encoding, for example using the Manchester code. The high and low time in the digital signal S3 may be balanced so that power remains continuous.

The power circuit 416 could include one or more Low Drop Out regulators (LDOs) or one or more charge pumps. The LDOs could be implemented without output capacitor and the charge pumps without external components since there are no pins for the power circuit 416.

The current driver 410 can be used to drive various current-controlled components such as an LED, or a string of LEDS in a single channel configuration. Alternatively the current regulator can be adapted to drive multiple LED channels, for instance 2 or 5 channels. In other implementations the current driver 410 can be used to drive a sensor device, or multiple sensor devices.

Figure 5:
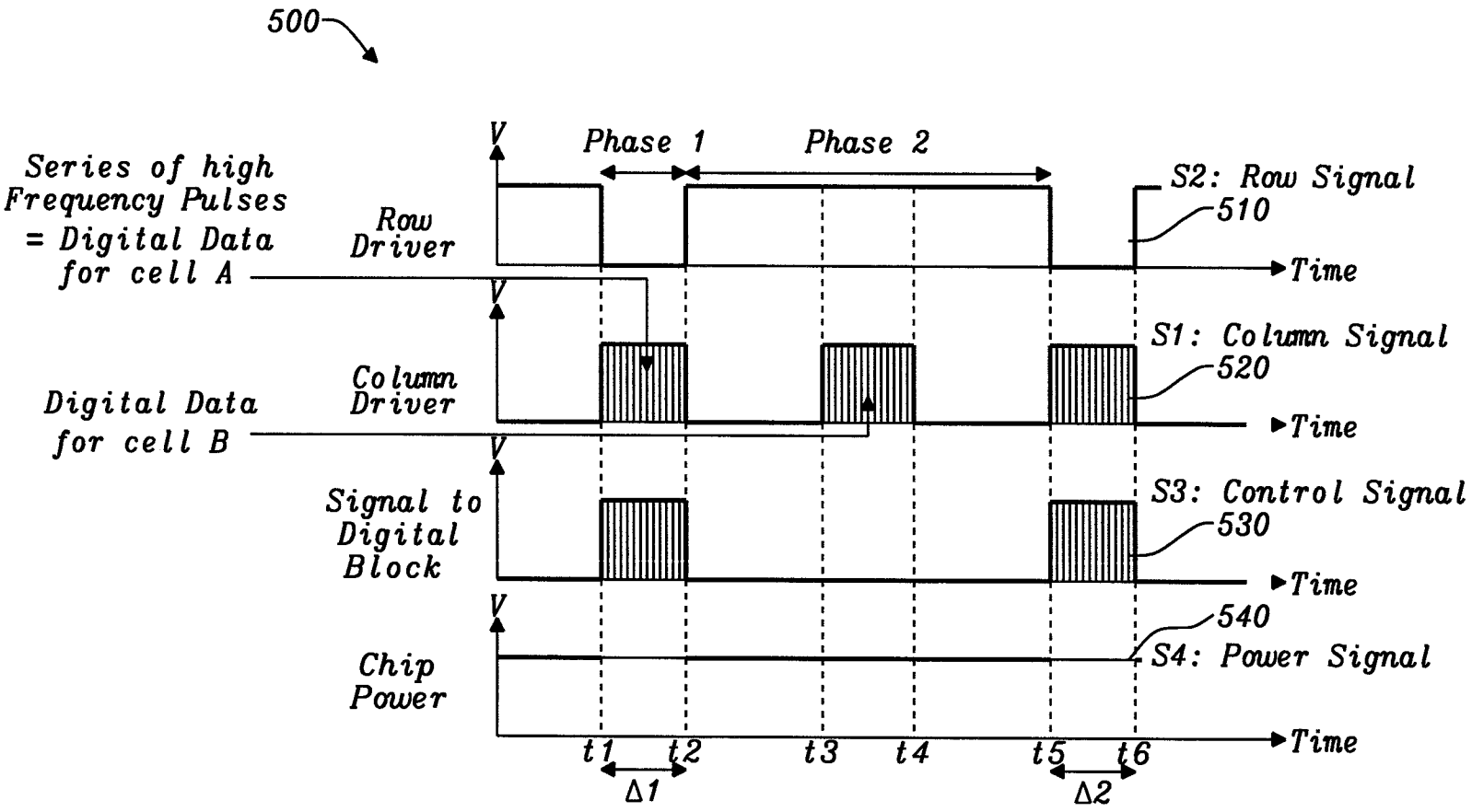
FIG. 5 is a waveform diagram illustrating the working of the circuit of FIG. 4A.

FIG. 5 is a waveform diagram illustrating the working of the circuit of FIG. 4A with reference to FIG. 4B. The diagram 500 shows the row signal S2 510 provided by the row driver, the column signal S1 520 provided by the column driver, the control signal S3 530, and the power signal S4 received by the power circuit 416.

The column signal S1 has a period Toff_1 when S1 is low and a period Ton_1 when the signal is high. The row signal S2 has a period Toff_2 when S2 is low and a period Ton_2 when the signal is high.

In operation, when the row signal S2 510 is low, that is during the periods Δ1 and Δ2, the control signal S3 530 is high. The current driver 410 is powered by the row driver during phase 2 and by the column driver during phase 1.

Before the time t1, S2 is high and S1 is low, the diode D1 is switched on while the diode D2 is switched off and the row driver charges the capacitor C. The signal S4 is equal to the voltage VA across the capacitor C. Therefore the current driver 410 receives its operating power from the row driver. The switch M1 is off (open) and the signal S3 530 is low. The control signal S3 is floating when M1 is off (open) and 0V if digital circuit pull down.

Between the times t1 and t2, S2 is low and S1 is high frequency pulses, the diode D1 is switched off while the diode D2 is switched on and the column driver charges the capacitor C. The signal S4 is equal to the voltage VA across capacitor C. Therefore the current driver receives its operating power from the column driver. The switch M1 is on (closed) and the signal S3 530 is a series of high frequency pulses. The series of high frequency pulses can encode data. Since S1 provides power when S2 is low, the series of high frequency pulses should be at least 50% high even if the data are all 0.

Between t2 and t3 the current driver 410 receives its operating power from the row driver.

Between t3 and t4 the current driver 410 receives its operating power from the row driver. Since the signals S1 and S2 are both high at least on of the diodes D1 and D2 is on or both are on. The higher signal between S1 (provided at D2) and S2 (provided at D1) will automatically disable the diode associated with the other signal. If S1 and S2 have the same amplitude, then D1 and D2 are both on to share the current to the power circuit 416. The switch has a gate to source voltage Vgs(M1)=S1−S2 that is less than the threshold voltage of M1 such that M1 is off. The high frequency pulses or digital data in S1 between t3 and t4 are for another current driver in another cell in which the row driver signal is low between t3 and t4.

When the control signal S3 530 is high frequency pulses, the current drive port 411*c* allows a regulated current to flow through the current controlled component 420. Using this approach there is no need for a TFT MOSFET as required in the prior art of FIG. 1A. This simplifies the circuit design, hence enabling greater pixel density while reducing manufacturing costs.

Figure 6A:
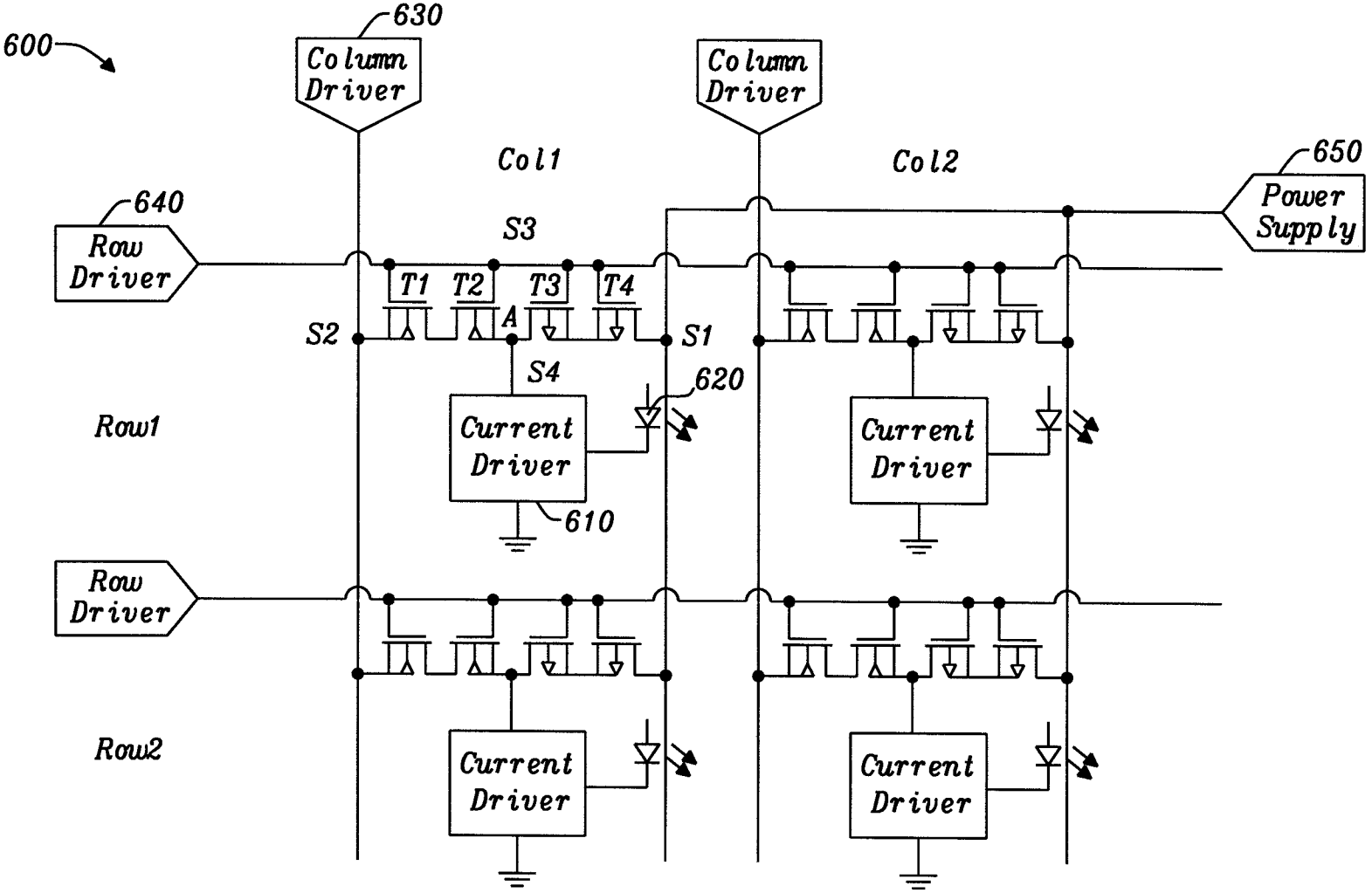
FIG. 6A is a diagram of another array of cells according to the disclosure.

FIG. 6A is a diagram of another circuit 600 according to the disclosure. The circuit 600 includes an array of cells, each cell having a current driver coupled to a current-controlled component. In this example the current-controlled component is a semiconductor light sources such as an LED or a string of LEDs. The array has a pluralities of columns Col1, Col2 and rows Row1, Row2. In this example four cells are represented: (Col1, Row1), (Col2, Row1), (Col1, Row2), (Col2, Row2).

A row driver 640 is provided for each row and a column driver 630 is provided for each column. Each row driver is adapted to provide a row signal S3 to a corresponding row. Similarly, each column driver is adapted to provide a column signal S2 to a corresponding column. In addition a power supply 650 is provided to provide a supply signal S1. It will be appreciated that many more cells could be implemented. The cells are identical and wired as follows and described with reference to the first cell (Col1, Row1).

The first cell includes four transistors T1, T2, T3, T4 and a 3-ports current driver 610 coupled to a current-controlled component 620. The first transistor T1 has a source terminal coupled to the column driver and a gate terminal coupled to the row driver. The second transistor T2 has a drain terminal coupled to the drain terminal of T1, a gate terminal coupled to the row driver, and a source terminal coupled to the current driver 610 and to the drain terminal of T3 at node A. The third transistor T3 has a drain terminal coupled to node A, a gate terminal coupled to the row driver, and a source terminal coupled to the source terminal of T4. The third transistor T4 has a gate terminal coupled to the row driver and a drain terminal coupled to the power supply 650. The transistors T1, T2, T3 and T4 may be MOSFET transistors such as TFT MSOFETS. For instance, T1 and T2 may be N-type transistors and T3 and T4 may be P-type transistors.

Figure 6B:
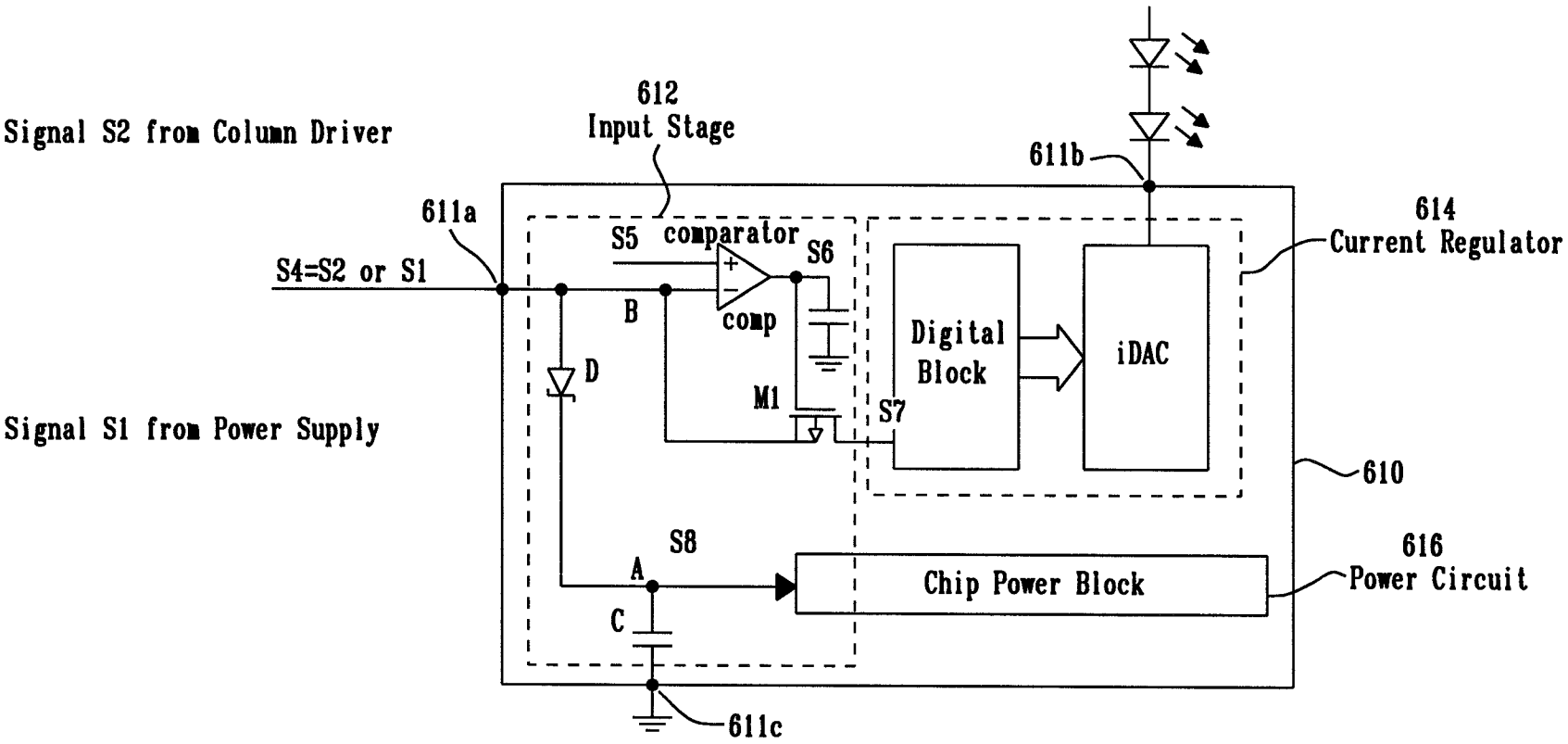
FIG. 6B is a diagram of a 3-ports current driver for use in the circuit 6A.

FIG. 6B shows a current driver 610 for driving a current-controlled component with a driving current. The current driver 610 includes a current regulator 614 for regulating the driving current; a power circuit 616 for powering the current regulator, and an input stage 612. The input stage 612 is adapted to receive a first signal (supply signal S1 from the power supply) and a second signal (column signal S2 from the column driver). The input stage 612 is operable in two phases. In the first phase (Phase A) the first signal S1 is used to power the power circuit 616, and the second phase (Phase B) the second signal S2 is used to power the power circuit 616.

In this example the current driver 610 is a 3-ports current driver for use in FIG. 6A. The current driver has as a first port, a second port, and a third port. The first port 611*a* is adapted to receive the signal S4, which may be either the column signal S2 from the column driver or the power signal S1 from the power source. Therefore a single port is provided to receive either the supply signal S1 or the column signal S2. The second port 611*b* also referred to current drive port is coupled to the current-controlled component 620. The ground port 611*c* is coupled to ground.

The input stage 612 could be implemented in different ways. In this example the input stage 612 has a single input for receiving the signal S4 and two outputs for providing a power signal S8 and a control signal S7. The input stage 612 has a diode D, a switch M1, a comparator Comp and a capacitor C. The capacitor C has a first terminal coupled the power circuit 616 at node A and a second terminal coupled to ground. The diode D has a first terminal coupled to the first port 611*a* and a second terminal coupled to the capacitor C at node A.

The comparator Comp has a first input, for instance an inverting input and a second input for instance a non-inverting input. The connections to the inverting and non-inverting input vary depending on the relative amplitudes of the supply signal S1, the column signal S2 and a reference signal S5, so that the output of the comparator (signal S6) is low between the times t1 and t2 (and between t3 and t4). When S2>S5>S1 (see FIG. 7), the reference signal S5 is coupled to the non-inverting input. When S2<S5<S1 (see FIG. 8), the reference signal S5 is coupled to the inverting input. The remaining input of the comparator is coupled to the first port 611*a* at node B. The reference signal S5 may be generated in various ways. For instance, the reference signal S5 may be generated using a regulated charge pump coupled to a voltage divider. The output of the comparator is coupled to the control terminal, for instance the gate terminal, of the switch M1. The switch M1 has a second terminal for instance a source terminal coupled to node B and a third terminal for instance a drain terminal coupled to the current regulator 614.

The current regulator 614 has an input for receiving the control signal S7 via the switch M1 and an output coupled to the second port 611*b*. The current regulator 614 can be implemented in various ways. In this example the current regulator includes a digital circuit coupled to a current digital-to-analog convertor iDAC. The signal S7 can be a digital data signal. For instance S7 may carry data using phase encoding, for example using the Manchester code.

The power circuit 616 could include one or more Low Drop Out regulators (LDOs) or one or more charge pumps. The LDOs could be implemented without output capacitor and the charge pumps without external components since there are no pins for the power circuit 616.

The current driver 610 can be used to drive various current-controlled components such as an LED, or a string of LEDS in a single channel configuration. Alternatively the current regulator can be adapted to drive multiple LED channels, for instance 2 or 5 channels. In other implementations the current driver 610 can be used to drive a sensor device, or multiple sensor devices.

Figure 7:
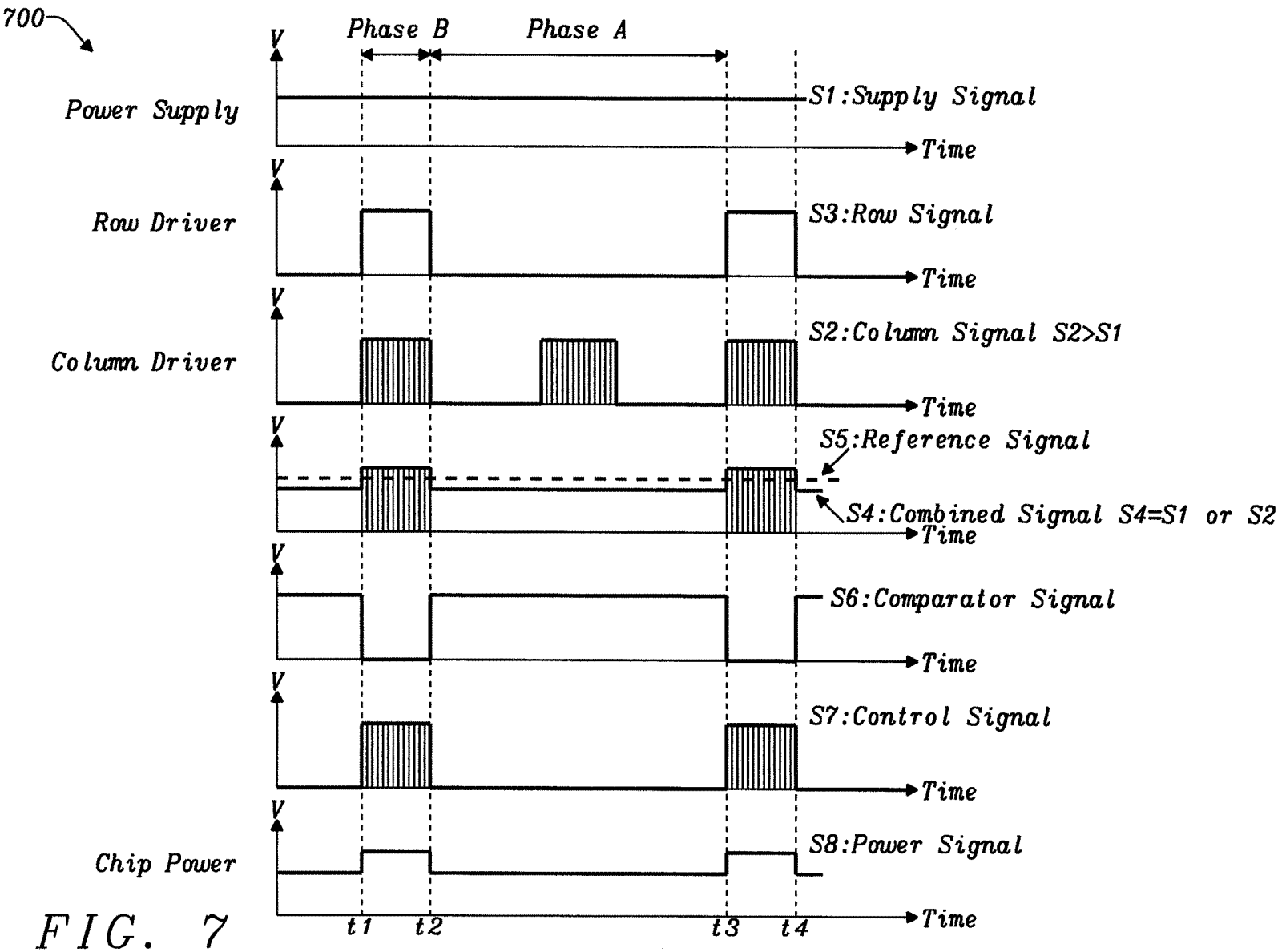
FIG. 7 is a waveform diagram illustrating the working of the circuit of FIG. 6A.

FIG. 7 is a waveform diagram illustrating the working of the circuit of FIG. 6A with reference to FIG. 6B. The diagram 700 shows the supply signal S1 from the power supply, the row signal S3 provided by the row driver, the column signal S2 provided by the column driver, the combined signal S4 (S4=S1 or S2, S4=S1 during Phase A and S4=S2 during Phase B), the reference signal S5, the output of the comparator S6, the control signal S7 to control the current regulator, and the power signal S8 received by the power circuit 616. In this example the supply signal S1 is lower than the column signal S2.

In operation, the row signal S3 is received at the gates of T1, T2, T3 and T4 and is used to select either the column signal S2 or the power signal S1 such as a constant voltage value. Before the time t1, the row signal S3 is low and the current driver 610 receives the power signal S1 (S4=S1) from the power supply 650 via transistors T3 and T4. Between the times t1 and t2, (Phase B) the row signal S3 is high and the current driver 610 receives the column signal S2 from the column driver via transistors T1 and T2. Between t2 and t3 (Phase A) the current driver 610 receives its operating power from the power supply 650 (S4=S1). Between t3 and t4 (Phase B) the current driver 610 receives its operating power from the column driver (S4=S2).

The comparator Comp compares the signal S4 with the reference signal S5 to provide the signal S6 that controls the switch M1. When S5 is greater than S4 (Phase A), S6 is high; the switch M1 is off (open) and S7 is low or floating. When S5 is lower than S4 (Phase B), that is between t1 and t2, and between t3 and t4, S6 is low and the switch M1 is on (closed) and S7 is high frequency pulses.

The combined signal S4 does not drop to 0V. Instead, the combined signal S4 toggles between a high voltage pulses state and a low voltage state. At time t1 the signal S4 increases (rising edge) and at time t2 the signal S4 decreases (falling edge). The signal S6 is decoded by observing the rising edge and falling edge of the combined signal S4. The signal S6 controls the switch M1 in a similar way to the previous example (in which the row signal S2 controls M1 in FIG. 5).

The power signal S8 toggles between a high voltage state and a low voltage state but does not drop to 0V, hence providing an uninterrupted voltage source to the power circuit. The capacitor C acts as a reservoir to provide power to the power circuit.

In this embodiment the current driver only requires 3 ports. A single port is used to receive the supply signal S1 and the column signal S2. This permits to reduce routing complexity. In turn a greater pixel density can be achieved. Since less substrate layer is required the cost of production can also be reduced.

Figure 8:
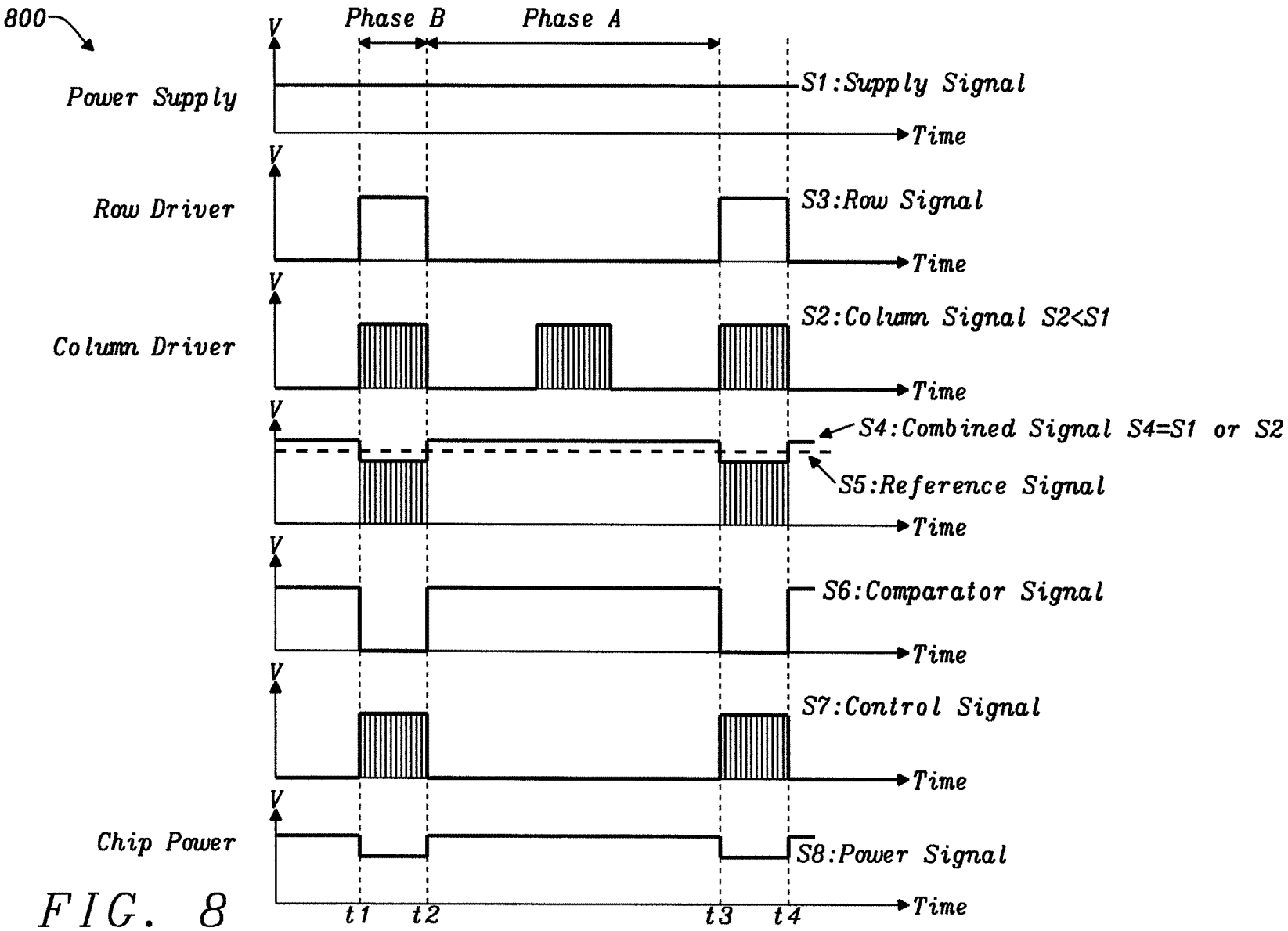
FIG. 8 is another waveform diagram illustrating the working of the circuit of FIG. 6A.

FIG. 8 shows another waveform diagram illustrating the working of the circuit of FIG. 6A. In this example the supply signal S1 is greater than the column signal S2. In this case at time t1 the signal S4 decreases (falling edge) and at time t2 the signal S4 increases (rising edge).

The circuit 600 is implemented with a current driver having only 3 ports. By reducing the number of ports from 4 to 3, the routing of the circuit is simplified. This improves assembly yield rate and production cost.

Figure 9:
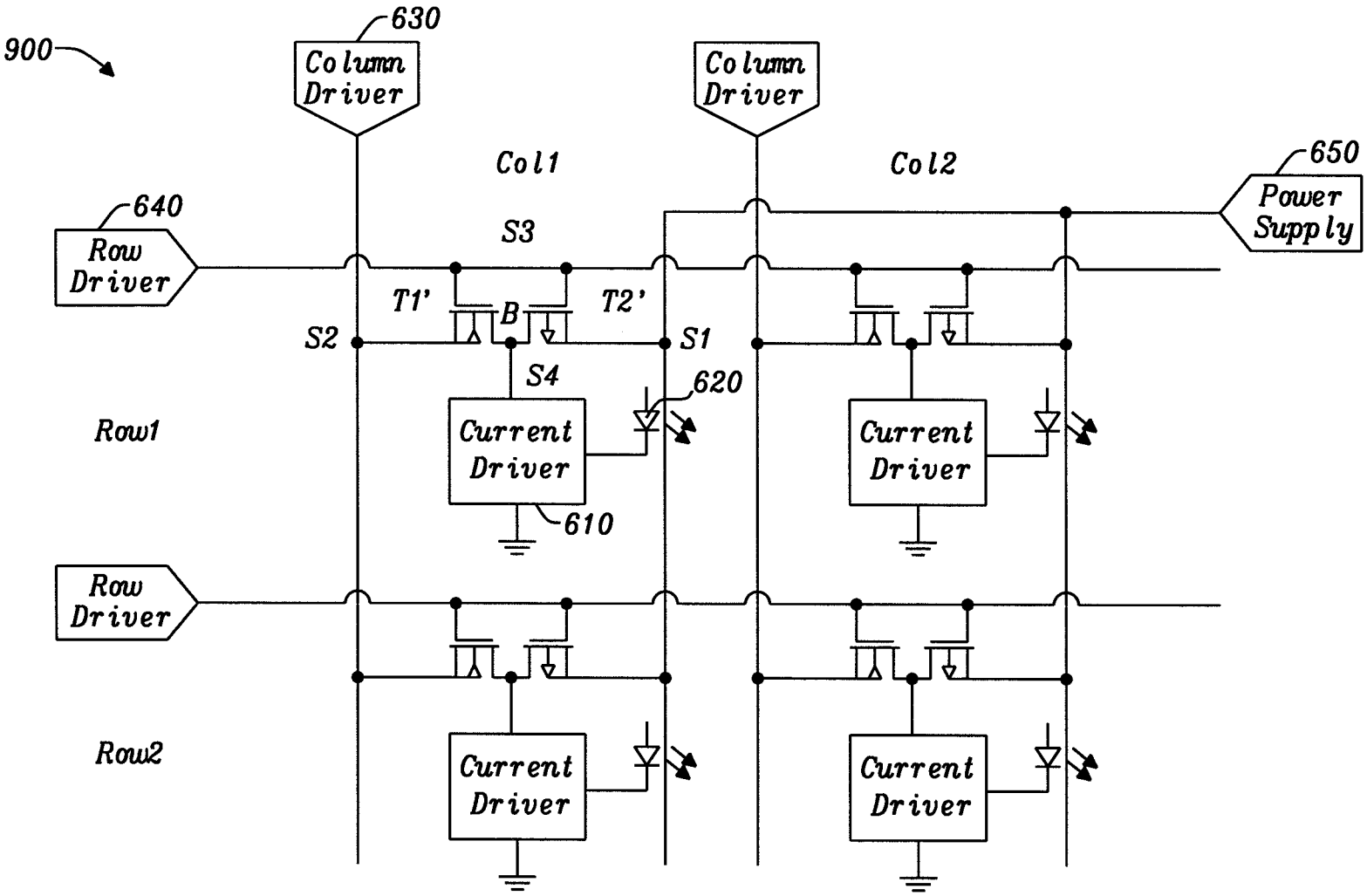
FIG. 9 is a diagram of another array of cells according to the disclosure.

FIG. 9 is a diagram of another circuit 900 according to the disclosure. The circuit 900 is similar to the circuit 600 of FIG. 6. The same reference numerals have been used to represent corresponding components and their description will not be repeated for sake of brevity. In FIG. 9 only two transistors T1' and T2' are provided, instead of four. The first transistor T1' has a source terminal coupled to the column driver 630, a gate terminal coupled to the row driver 640, and a drain terminal coupled to the current driver 610 and to the drain terminal of T2' at node B. The second transistor T2' has a drain terminal coupled to node B, a gate terminal coupled to the row driver 640, and a source terminal coupled to the power supply 650. The transistors T1' and T2' may be MOSFET transistors such as TFT MSOFETS. For instance, T1' may be a N-type transistor and T2' may be a P-type transistor.

The operation of the circuit of the circuit 900 is similar to the operation of the circuit 600, however in this case due to the body diode of the transistors T1' and T2', the supply signal S1 must be greater than or equal to the peak voltage of column signal S2. As a result, the circuit operation can be illustrated with reference to FIG. 8 as follows. The row signal S3 is received at the gates of transistors T1' and T2' and is used to select either the column signal S2 or the supply signal S1 such as a constant voltage value. Before the time t1, the row signal S3 is low, T1' is off (open) and T2' is on (closed) and the current driver 610 receives the supply signal S1 from the power supply 650 via transistors T2'. Between the times t1 and t2 (Phase B), the row signal S3 is high, T1' is on (closed) and T2' is off (open) and the current driver 610 receives the column signal S2 from the column driver via transistors T1'. Between t2 and t3 (Phase A) the current driver 610 receives its operating power from the power supply 650. Between t3 and t4 (Phase B) the current driver 610 receives its operating power from the column driver.

The power signal S8 toggles between a high voltage state and a low voltage state but does not drop to 0V, hence providing an uninterrupted voltage source to the power circuit. Compared with the circuit 600, this embodiment permits to reduce the number of transistors from four to only 2.

The current drivers and array circuits of the disclosure can be used in various applications including backlighting applications such as MiniLED and MicroLED backlighting applications. The array circuits of the disclosure provide individual light source dimming functionality while at the same time reducing the routing and complexity of the circuit. Greater pixel density can be achieved while reducing component and manufacturing costs. The same approach could be used in an array of sensors in which the current-controlled component is a sensor device.

A skilled person will appreciate that variations of the disclosed arrangements are possible without departing from the disclosure. For instance, it will be appreciated that the current driver described in the present disclosure could be used in various applications, and as such is not limited to the control of LEDs. Accordingly, the above description of the specific embodiment is made by way of example only and not for the purposes of limitation. It will be clear to the skilled person that minor modifications may be made without significant changes to the operation described.

What is claimed is:

1. A current driver for driving a current-controlled component with a driving current, the current driver comprising a current regulator for regulating the driving current;

a power circuit; and an input stage configured to receive a first signal via a column driver and a second signal via a row driver or a power supply, the input stage being operable in a first phase during which the first signal is used to power the power circuit, and a second phase during which the second signal is used to power the power circuit;

wherein the input stage comprises a first port, the input stage further comprising a diode coupling the first port to a capacitor and to the power circuit.

2. The current driver as claimed in claim 1, wherein the input stage is adapted to provide a control signal to control the current regulator.

3. The current driver as claimed in claim 1, wherein the first port is for receiving the first signal, and wherein the input stage has a second port for receiving the second signal.

4. The current driver as claimed in claim 3, wherein the input stage comprises a second diode coupling the second port to the capacitor, and a switch having a control terminal coupled to the second port.

5. The current driver as claimed in claim 1, wherein the first port is a single input port for receiving the first signal or the second signal.

6. The current driver as claimed in claim 5, wherein the input stage comprises a comparator coupled to the single input port, and a switch having a control terminal coupled to the output of the comparator.

7. The current driver as claimed in claim 1, wherein the current driver is a semiconductor light source driver.

8. A device comprising an array of cells, each cell comprising a current driver coupled to a current-controlled component, the current driver comprising a current regulator for regulating a driving current;

a power circuit; and an input stage configured to receive a first signal via a column driver and a second signal via a row driver or a power supply, the input stage being operable in a first phase during which the first signal is used to power the power circuit, and a second phase during which the second signal is used to power the power circuit;

wherein the input stage comprises a first port, the input stage further comprising a diode coupling the first port to a capacitor and to the power circuit.

9. The device as claimed in claim 8, wherein the array comprises a pluralities of columns and rows; a plurality of row drivers, each row driver being adapted to provide a row signal to a corresponding row, and a plurality of column drivers, each column driver being adapted to provide a column signal to a corresponding column.

10. The device as claimed in claim 9, wherein each current driver comprises the first port and a second port, wherein the first port is for receiving the column signal and the second port for receiving the row signal.

11. The device as claimed in claim 9, wherein when the row signal is high the current driver is powered by the row driver and when the row signal is low the current driver is powered by the column driver.

12. The device as claimed in claim 9, further comprising the power supply, wherein the current driver is coupled to the column driver via a first switch and to the power supply via a second switch.

13. The device as claimed in claim 12, wherein the row signal has a first state and a second state, the row signal being adapted to control the first switch and the second switch such that when the row signal is in the first state the current driver is powered by the power supply and when the row signal is in the second state the current driver is powered by the column signal.

14. The device as claimed in claim 12, wherein the first switch comprises a single transistor and the second switch comprises a single transistor.

15. The device as claimed in claim 12, wherein the first switch comprises a first pair of transistors and the second switch comprises a second pair of transistors.

16. The device as claimed in claim 15, wherein the first pair comprises a first transistor and a second transistor, wherein the first transistor has a drain terminal connected to the drain terminal of the second transistor; and wherein the second pair comprises a third transistor and a fourth transistor, wherein the third transistor has a source terminal connected to the source terminal of the fourth transistor.

17. The device as claimed in claim 9, wherein the device is a display device comprising a plurality of semiconductor light sources, each semiconductor light source among the plurality of light sources being coupled to a corresponding current driver.

18. A method of driving a current-controlled component with a driving current, the method comprising providing a current regulator for regulating the driving current;

providing a power circuit;

generating a first signal using a column driver and a second signal using a row driver or a power supply;

providing an input stage configured to receive the first signal and the second signal, wherein the input stage comprises a first port, the input stage further comprising a diode coupling the first port to a capacitor and to the power circuit, operating the input stage in a first phase during which the first signal is used to power the power circuit, and operating the input stage in a second phase during which the second signal is used to power the power circuit.

* * * * *